US009783761B2

(12) United States Patent
Balasubramaniam et al.

(10) Patent No.: US 9,783,761 B2
(45) Date of Patent: Oct. 10, 2017

(54) HIGH VISCOSITY LUBRICANT COMPOSITIONS MEETING LOW TEMPERATURE PERFORMANCE REQUIREMENTS

(75) Inventors: Vasudevan Balasubramaniam, Goshen, NY (US); Mark Witschger, Cincinnati, OH (US); Uwe Förster, Düsseldorf (DE)

(73) Assignee: COGNIS IP MANAGEMENT GmbH, Duesseldorf (DE)

( * ) Notice: Subject to any disclaimer, the term of this patent is extended or adjusted under 35 U.S.C. 154(b) by 252 days.

(21) Appl. No.: 13/414,834

(22) Filed: Mar. 8, 2012

(65) Prior Publication Data

US 2012/0289445 A1 Nov. 15, 2012

Related U.S. Application Data

(60) Provisional application No. 61/450,247, filed on Mar. 8, 2011.

(51) Int. Cl.
*C10M 169/04* (2006.01)

(52) U.S. Cl.
CPC .... *C10M 169/041* (2013.01); *C10M 169/044* (2013.01); *C10M 2201/1023* (2013.01); *C10M 2203/1025* (2013.01); *C10M 2205/02* (2013.01); *C10M 2205/022* (2013.01); *C10M 2205/028* (2013.01); *C10M 2205/0285* (2013.01); *C10M 2207/2805* (2013.01); *C10M 2207/2825* (2013.01); *C10M 2229/02* (2013.01); *C10N 2220/022* (2013.01); *C10N 2230/02* (2013.01); *C10N 2240/04* (2013.01); *C10N 2240/042* (2013.01); *C10N 2240/044* (2013.01)

(58) Field of Classification Search
CPC ..... C10M 169/044; C10M 2201/1023; C10M 2203/1025; C10M 2205/02; C10M 2205/022; C10M 2205/028; C10M 2205/0285; C10M 2207/2825; C10M 2229/02; C10M 2207/2805; C10N 2240/044; C10N 2220/022; C10N 2230/02; C10N 2240/04; C10N 2240/042
USPC ..... 508/110
See application file for complete search history.

(56) References Cited

U.S. PATENT DOCUMENTS

| | | | | |
|---|---|---|---|---|
| 3,859,219 | A * | 1/1975 | Hotten | C10M 137/16 508/259 |
| 4,956,122 | A * | 9/1990 | Watts | C10M 111/04 508/485 |
| 5,763,372 | A | 6/1998 | Tersigni et al. | |
| 2003/0186824 | A1* | 10/2003 | Chiu | C10M 101/04 508/490 |
| 2004/0192564 | A1* | 9/2004 | Balasubramaniam et al. | 508/436 |
| 2006/0276355 | A1 | 12/2006 | Carey et al. | |
| 2007/0164259 | A1 | 7/2007 | Sullivan et al. | |
| 2010/0105585 | A1* | 4/2010 | Carey et al. | 508/162 |

FOREIGN PATENT DOCUMENTS

| | | |
|---|---|---|
| EP | 1191090 | 3/2002 |
| EP | 1191090 A2 * | 3/2002 |
| WO | WO-2011/054482 | 5/2011 |

OTHER PUBLICATIONS

"International Search Report and Written Opinion in PCT/EP2012/053717", Apr. 24, 2012 , 10 pgs.
FAQ—Gear & Hydraulic Lubricant, *The Oil Doctor, Truck/Auto Marine Industrial Fleet* 2013, 2 pages.

* cited by examiner

*Primary Examiner* — Taiwo Oladapo
(74) *Attorney, Agent, or Firm* — Servilla Whitney LLC

(57) ABSTRACT

A lubricant composition characterized as having a viscosity of less than about 150,000 cP at −40° C., a kinematic viscosity of less than about 150,000 cSt at −40° C., and a kinematic viscosity of at least about 18.5 cSt at 100° C. for use in association with a device involving metal to metal contact of moving parts comprising: (a) base-stock comprising (i) at least one relatively low viscosity polyalphaolefin, (ii) at least one ester, and at least one Group III base oil; (b) viscosity improver comprising (i) at least one relatively high viscosity polyalphaolefin, and (ii) a least one olefin copolymer; (c) a performance additive comprising at least one additive effective to improve at least one property of the lubricant and/or the performance of the equipment in which the lubricant is to be used; (d) at least one pour-point depressant; and, optionally, (e) at least one antifoam agent.

8 Claims, No Drawings

HIGH VISCOSITY LUBRICANT COMPOSITIONS MEETING LOW TEMPERATURE PERFORMANCE REQUIREMENTS

CROSS-REFERENCE TO RELATED APPLICATIONS

This application claims the benefit under 35 U.S.C. §119 (e) to U.S. Provisional Application No. 61/450,247, filed Mar. 8, 2011, which is incorporated herein by reference in its entirety.

FIELD OF THE INVENTION

This invention relates to lubricant compositions having utility in numerous applications, particularly in connection with gear, transmission and/or axle applications in the automotive and machinery industries.

BACKGROUND OF THE INVENTION

An important function of lubricant compositions, and in particular gear and axle lubricant fluids, is to provide a high degree of reliability and durability in the service life of equipment in which it is installed. Lubricating oils in general, and gear and axle lubricants in particular, frequently must satisfy a relatively large number of performance criteria to be commercially successful. For example, a commercially successful axle lubricant will frequently be required to possess a high degree of oxidative stability, compatibility, shear stability, corrosion avoidance or resistance, wear protection, shiftability, and extended drain. Beyond this, it is desirable for a high viscosity lubricant composition to meet low temperature performance requirements. These properties represent a difficult to achieve set of performance criteria.

Gear lubricant compositions are classified by the American Petroleum Institute ("API") using "GL" ratings. These classifications are subdivided into six classes. The lowest rating, API GL-1, classifies oils used for light conditions, which consist of base oils without additives. The highest rating, API GL-6, classifies oils for very heavy conditions, such as high speeds of sliding and significant shock loading, and which contain up to 10% high performance antiscuffing additives. However, class API GL-6 is not applied any more as it is considered that class API GL-5 will meet most severe requirements. Lubricant compositions classified meeting API GL-5 performance requirements are generally applied, for example, in hypoid gears having significant displacement of axles.

The viscosity-temperature relationship of a lubricating composition is another of the critical criteria to be considered when selecting a lubricant for a particular application. Mineral oils commonly used as a base for single and multigraded lubricants exhibit a relatively large change in viscosity with a change in temperature. Fluids exhibiting such a relatively large change in viscosity with temperature have a low viscosity index. The Society of Automotive Engineers ("SAE") publication SAE J306 describes viscometric qualifications for axle and gear lubricant compositions. This classification is based on the lubricant viscosity measured at both high and low temperatures. The high-temperature kinematic viscosity values are determined according to ASTM D 445, with the results reported in centistokes (cSt). The low-temperature viscosity values are determined according to ASTM D 2983 and the results are reported in centipoise (cP). These two viscosity units are related as follows in Equation 1:

$$(cP/(Density, g/cm^3))=cSt \quad \text{(Eq. 1)}$$

The following Table 1 summarizes high and low temperature requirements for qualifications of axle and gear lubricant compositions.

TABLE 1

| SAE Viscosity Grade | Maximum Temerature for Viscosity of 150,000 cP, ° C. | Viscosity at 100° C., cSt Minimum | Viscosity at 100° C., cSt Maximum |
|---|---|---|---|
| 7OW | −55 | 4.1 | — |
| 75W | −40 | 4.1 | — |
| 80W | −26 | 7.0 | — |
| 85W | −12 | 11.0 | — |
| 80 | — | 7.0 | <11.0 |
| 85 | — | 11.0 | <13.5 |
| 90 | — | 13.5 | <18.5 |
| 110 | — | 18.5 | <24.0 |
| 140 | — | 24.0 | <32.5 |
| 190 | — | 32.5 | <41.0 |
| 250 | — | 41.0 | — |

These SAE standards are intended for use by equipment manufacturers in defining and recommending automotive gear, axle, and manual transmission lubricants, for oil marketers in labeling such lubricants with respect to their viscosity, and for users in following their owner's manual recommendations.

A lubricant composition's viscosity may be defined in two ways: (1) based on its kinematic viscosity; or (2) based on its apparent (Brookfield) viscosity. Kinematic viscosity is defined as a lubricant composition's resistance to flow and shear due to gravity. Apparent viscosity relates a lubricant composition's resistance to flow and shear due to internal friction.

High temperature viscosity is related to the hydrodynamic lubrication characteristics of the fluid. Some lubricant compositions may contain high molecular weight polymers, known as viscosity modifiers or viscosity index improvers, which function to increase the viscosity of the fluids. During use, however, these polymers may shear to a lower molecular weight, thereby resulting in a fluid with a lower viscosity than that of the new fluid. Low temperature viscosity requirements are related to the ability of the fluid to flow and provide adequate lubrication to critical parts under low ambient temperature conditions.

Lubricating compositions meeting SAE viscosity grade 75W-110 are known. For example, EP 1191090 discloses lubricating compositions comprising (a) from about 40-70% by weight of mineral oil, (b) from about 2-20% by weight of vinyl aromatic-diene copolymers, olefin copolymers, and mixtures thereof, (c) from about 2-20% by weight of a high viscosity polyalphaolefin, and (d) from about 3-20% by weight of a gear additive package.

Applicants have come to recognize, however, that although a substantial number of lubricant compositions have been produced having various needed properties where such lubricant compositions are used, there exists a need for lubricant compositions comprising API Group III mineral base oils that provide improved high viscosity lubricant compositions meeting low temperature performance requirements. While acceptable performance of the gear oil is a requirement, it is also highly desirable that the lubricant compositions be low in cost and easily produced. Accordingly, there is a need in the art for a lubricant composition that meets these industry standards and further provides cost-effective alternatives that may be easily produced, and in particular lubricant compositions classified as SAE 75W-110 meeting GL-5 performance requirements and having an apparent viscosity of less than about 150,000 cP at −40° C.

SUMMARY OF THE INVENTION

Applicants have developed improved lubricant compositions, and in many embodiments, lubricant compositions that satisfy a relatively high level of performance for the criteria mentioned above. As used herein, the term "lubricant composition" is used in its broadest sense to include fluid compositions that are used in applications involving metal to metal contact of parts in which at least one function of the fluid is to inhibit or reduce friction between the parts. As such, the term "lubricant composition" as used herein includes gear oils, axle oils, and the like.

In certain embodiments, the lubricant compositions of the present invention comprise: (a) base-stock; (b) viscosity improver; (c) at least one additive package; (d) at least one pour-point depressant; and, optionally, (e) at least one antifoam agent. Certain lubricant compositions of the present invention comprise: (a) base-stock comprising (i) at least one low viscosity polyalphaolefin ("PAO"), (ii) at least one ester, and (iii) at least one API Group III mineral base oil; (b) viscosity improver comprising (i) at least one high viscosity PAO, and (ii) at least one olefin copolymer; (c) a performance additive package comprising at least one additive effective to improve at least one property of the lubricant and/or the performance of the equipment in which the lubricant is to be used; (d) at least one pour-point depressant; and, optionally, (e) at least one antifoam agent. In certain embodiments the lubricant compositions of the present invention are multiviscosity-grade lubricants having an apparent viscosity of 150,000 cP at a maximum temperature of not greater than about −40° C. and a kinematic viscosity at 100° C. of not less than about 18.5 cSt, meet API GL-5 performance requirements, and have an apparent viscosity of less than 150,000 cP at −40° C.

Applicants have found that certain embodiments of the present lubricant compositions having anSAE viscosity classification of 75W-110 and meeting API GL-5 performance requirements comprise:

(a) about 1-46% by weight of a low viscosity PAO;
(b) about 5-30% by weight of an ester;
(c) about 1-23% by weight of a Group III mineral base oil;
(d) about 10-30% by weight of a high viscosity PAO;
(e) about 1-25% by weight of an olefin copolymer;
(f) about 5-12% by weight of an additive package;
(g) about 0.1-2% by weight of a pour-point depressant agent; and, optionally
(h) about 0.001-0.004% by weight of an antifoam agent.

Applicants have found that certain SAE 75W-110 lubricant compositions of the present invention meet API GL-5 performance requirements and provide cost-effective lubricant compositions that exhibit improved low temperature performance in ring and pinion gears with respect to one or more, and preferably all, of the following advantageous properties: ridging, rippling, pitting, spalling, scoring, and wear.

DETAILED DESCRIPTION OF PREFERRED EMBODIMENTS

The present invention is directed in one aspect to lubricant compositions comprising: (a) base-stock; (b) viscosity improver; (c) at least one additive; (d) at least one pour-point depressant; and, optionally, (e) at least one antifoam agent. In certain embodiments the lubricant composition is a multiviscosity-grade lubricant having an apparent viscosity of 150,000 cP at a maximum temperature of not greater than about −40° C. and a kinematic viscosity at 100° C. of not less than about 18.5 cSt, meet API GL-5 performance requirements, and have an apparent viscosity of less than 150,000 cP at −40° C. In certain embodiments, the base-stock of the present invention comprises: (i) a low viscosity PAO; (ii) at least one ester; and (iii) at least one Group III mineral base oil. In certain embodiments, the viscosity improver of the present invention comprises: (i) at least one high viscosity PAO; and (ii) at least one olefin copolymer. In certain embodiments, the performance additive package comprises at least one additive effective to improve at least one property of the equipment in which the lubricant is to be used. The present invention also provides methods of making and using a fully formulated lubricant, including a fully formulated heavy duty axle fluid, and to axle, gear, transmission or drive systems containing such oils.

In general, it is contemplated that these components of the present invention may be present in compositions in widely varying amounts depending on the particular needs of each application, and all such variations are considered to be within the broad scope of the invention. Applicants have found that certain lubricant compositions of the present invention, when used in connection with ring and pinion gears, exhibit and/or produce advantageous properties with respect to one or more, and preferably all, of the following: ridging, rippling, pitting, spalling, scoring, and wear.

The PAOs of the present invention comprise a class of hydrocarbons that can be manufactured by the catalytic oligomerization (polymerization to low-molecular-weight procedures) of linear α-olefins typically ranging from 1-octene to 1-dodecene, with 1-decene being a preferred material, although polymers of lower olefins such as ethylene and propylene may also be used, including copolymers of ethylene with higher olefins. In general, numerous particular compounds or combinations of compounds are available for use in connection with each of the components as described herein.

In certain embodiments, the base-stock of the present invention comprises at least one low viscosity PAO, at least one diester, and at least one API Group III mineral base oil. With respect to the low viscosity PAO of the present invention, in certain embodiments the low viscosity PAO comprises a polyalphaolefin having a viscosity of about 4 cSt at 100° C. In one embodiment, the low viscosity PAO of the present invention comprises PAO-4. Further examples of such low viscosity PAOs should be apparent to one of ordinary skill in the art. With respect to the ester of the present invention, in certain embodiments the ester comprises a diester, preferably di-isodecyl adipate, and more preferably Cognis Synative 2970. In yet other embodiments, the diester comprises a decyl adipate, and even more particularly one or more adipate esters selected from the group consisting of di-isodecyl adipate, di-isodecyl azelate, and di-tridecyl adipate. In yet other embodiments, the diester can be substituted with a comparable polyol ester, preferably selected from the group consisting of derivatives of trimethylolpropane trioleate, 1,2, propylene glycol dioleate, neopentylglycol dioleate, and mixtures thereof. With respect to the API Group III mineral base oil of the present invention, the API has categorized Group III base oils as comprising less than or equal to 0.03 percent by weight of sulfur, more than or equal to 90 percent by volume of saturates, and a viscosity index of greater than 120. In certain embodiments, the lubricant compositions of the present invention comprise a low viscosity PAO in an amount of from about 1-46% by weight, preferably of from about 12-23% by weight. In certain embodiments, the lubricant compositions of the present invention comprise a diester in an amount of from about 5-30% by weight, preferably of from about 7.5-20% by weight. In certain embodiments, the lubricant compositions of the present invention comprise a Group III mineral base oil in an amount of from about 1-23% by weight, preferably 12-23% by weight. In certain embodiments, the ester can be substituted with combinations of the low viscosity PAO and API Group III mineral base oils.

In certain embodiments, the viscosity improver of the present invention comprises at least one high viscosity PAO and at least one olefin copolymer. With respect to the high viscosity PAO of the present invention, in certain embodiments the high viscosity PAO comprises a polyalphaolefin having a viscosity of not less than about 40 cSt, and preferably of from about 40 to about 1000 cSt. In one embodiment, the high viscosity PAO of the present invention comprises ExxonMobil or Chemtura PAO-100. Further examples of such high viscosity PAOs should be apparent to one of ordinary skill in the art. With respect to the olefin copolymers of the present invention, in certain embodiments the olefin copolymer has a molecular weight range of from about 8,000 (MW) to about 24,000 (MW). The olefin copolymers are ethylene-alpha-olefin copolymers comprising ethylene and one or more alpha-olefins of formula $H_2C{=}CHR$ wherein R is a hydrocarbon radical of from 1 to 10 carbon atoms. The copolymer-forming monomers can optionally include a conjugated polyene. Preferred alpha-olefins include propylene, 1-butene, 1-pentene, 1-hexene, 3-methyl pentene, 1-heptene, 1-octene, and 1-decene. The optional nonconjugated polyenes include aliphatic dienes such as 1,4-hexadiene, 1,5-hexadiene, 1,4-pentadiene, 2-methyl-1,4-pentadiene, 3-methyl-1,4-hexadiene, 1,9-decadiene, and exo- and endo-dicyclopentadiene; exo- and endo-alkenylnorbornenes such as 5-methyl-6-propenylnorbornene; alkylidenenorbornenes such as 5-methylene, 5-ethylidene and 5-isopropylidene-2-norbornene, vinylnorbornene and cyclohexylnorbornene; alkylnorbornadienes such as methyl-, ethyl-, and propylnorbornadiene; and cyclodienes such as 1,5-cyclooctadiene and 1,4-cyclooctadiene. Further examples of such olefin copolymers should be apparent to one of ordinary skill in the art. While it is contemplated that a large range of relative concentrations of such components may be present, in general, the lubricant compositions of the present invention comprise a high viscosity PAO in an amount of from about 10-30% by weight, preferably of from about 15-25% by weight. In certain embodiments, the lubricant compositions of the present invention comprise an olefin copolymer in amount of from about 1-25% by weight, preferably of from about 10-20% by weight.

In certain embodiments, the performance additive package of the present invention comprises at least one additive effective to improve at least one property of the lubricant and/or the performance of the equipment in which the lubricant is to be used. In certain embodiments, the performance additive comprises at least one additive based on sulfur chemistry and at least one additive based on phosphorous chemistry. A typical additive package would normally contain one or more of a dispersant, antioxidant, corrosion inhibitor, anti-wear agent, anti-rust agent, and extreme pressure agent. In certain embodiments, the additive package typically contains one or more additive selected from the group consisting of dispersants, corrosion inhibitors, extreme pressure additives, anti-wear additives, rust inhibitors, antioxidants, deodorizers, defoamers, demulsifiers, dyes, friction modifiers, and fluorescent coloring agents. The additive package may be, although it does not have to be, a fully-formulated additive package, such as a package meeting the requirements for API GL-5 and/or SAE J2360 performance. The type and amount of the components present in the gear additive package will depend on the intended final use of the product. In one embodiment, the additive package comprises Lubrizol Ang 6004 and/or Afton HiTEC® 385. Further examples of such additives should be apparent to one of ordinary skill in the art. In certain embodiments, the lubricant compositions of the present invention comprise a performance additive in an amount of from about 5-10% by weight, preferably 7.5-9% by weight.

In certain embodiments, the lubricant composition of the present invention comprises a pour-point depressant designed to prevent wax crystals in the lubricant composition from agglomerating or fusing together at reduced temperatures. In certain embodiments, the pour-point depressant comprises HiTEC® 5739 and/or HiTEC® 5738. Further examples of such pour-point depressants should be apparent to one of ordinary skill in the art. In certain embodiments, the lubricant compositions of the present invention comprise a pour-point depressant in an amount of from about 0.1-2.0% by weight, preferably of from about 0.1-1.0% by weight.

In certain embodiments, the lubricant composition of the present invention optionally comprises an antifoam agent. In certain embodiments, the antifoam agent comprises silicones and miscellaneous organic compounds. In certain other embodiments, the antifoam agent comprises lower molecular weight dimethyl siloxane. In one embodiment, the antifoam agent comprises Dow Corning DC-200/300 to 60,000 cSt. Further examples of such antifoam agents should be apparent to one of ordinary skill in the art. In certain embodiments, the lubricant compositions of the present invention comprise an antifoam agent in an amount of from about 0.001-0.004% by weight.

The present lubricant compositions may be prepared by mixing the components together at a temperature of from about 35° C. to about 95° C., preferably from about 65° C. to about 85° C. The base-stocks, viscosity improvers, and additives are placed in a suitable metal or glass vessel. Mechanical agitation is supplied to promote mixing. Sufficient mixing time is utilized to ensure that a homogeneous product is present. The process for making the lubricant compositions of the present invention should be known to and appreciated by one of ordinary skill in the art given the present disclosure. One of ordinary skill in the art would appreciate that this method of preparation is not limiting to the invention, and that one or more components may be modified in accordance with the teachings herein or that which is known in the art.

The lubricant compositions of the present invention preferably meet the requirements of both low-temperature and high-temperature grade lubricants, and in certain embodiments are multiviscosity-grade lubricants. Certain lubricant compositions of the present invention are classified as SAE 75W-110 lubricants and meet the low-temperature requirements for SAE 75W and the high-temperature requirements for SAE 110. In certain embodiment embodiments, the lubricant compositions of the present invention are classified as SAE 75W-140 lubricants and meet the high-temperature requirements for SAE 140. Lubricant compositions classified as SAE 75W have a viscosity of about 150,000 cP at −40° C. Lubricant compositions classified as SAE 110 are those having a kinematic viscosity at 100° C. of at least about 18.5 cSt and less than about 24.0 cSt. Lubricant compositions classified as SAE 140 are those having a kinematic viscosity at 100° C. of at least about 24.0 cSt and less than about 32.5 cSt. In preferred embodiments, the lubricant compositions of the present invention have an apparent viscosity of less than about 150,000 cP at −40° C.

In certain embodiments the lubricant compositions of the present invention meet API Category GL-5 performance requirements, and in yet other embodiments meet the SAE J2360 performance standard. Certain lubricant compositions of the present invention are intended for gears. In certain embodiments, the lubricant compositions are intended for gears in automotive axles equipped with hypoid gears, operating under various combinations of high-speed/shock-load and low-speed/high-torque conditions. Certain lubricant compositions of the present invention meet the API Category GL-5 performance requirements outlined by the following tests and acceptance criteria: (1) Standard Version of L-42; (2) Canadian Version of L-42; (3) Standard Version of test method ASTM D 6121; (4) Canadian Version of test method ASTM D 6121; (5) test method ASTM D 7038 or L-33; (6) test method ASTM D 5704 or L-60; (7) test method ASTM D 892; and (8) test method ASTM D 130.

Based on the foregoing, one embodiment of the lubricant compositions of the present invention comprises: (a) a low viscosity PAO; (b) an ester; (c) a Group III mineral base oil; (d) a high viscosity PAO; (e) an olefin copolymer; (f) an additive package imparting SAE J2360 performance; (g) a pour-point depressant; and, optionally (h) an antifoam agent; wherein the lubricant composition is a multiviscosity-grade lubricant having a SAE viscosity classification of 75W-110 and meets API Category GL-5 performance requirements. Applicants have found that in certain embodiments the present lubricant compositions comprise:

(a) about 1-46% by weight of a low viscosity PAO;
(b) about 5-30% by weight of an ester;
(c) about 1-23% by weight of a Group III mineral base oil;
(d) about 10-30% by weight of a high viscosity PAO;
(e) about 1-25% by weight of an olefin copolymer;
(f) about 5-10% by weight of an additive package;
(g) about 01.-2.0% by weight of a pour-point depressant; and, optionally
(h) about 0.001-0.004% by weight of an antifoam agent.

In certain other embodiments, the present lubricant composition comprises:

(a) about 12-23% by weight of a low viscosity PAO;
(b) about 7.5-20% by weight of a diester;
(c) about 12-23% by weight of a Group III mineral base oil;
(d) about 15-25% by weight of a high viscosity PAO;
(e) about 10-20% by weight of an olefin copolymer;
(f) about 7.5-9% by weight of an additive package;
(g) about 0.1-1.0% by weight of a pour-point depressant; and, optionally
(h) about 0.001-0.004% by weight of an antifoam agent.

The instant invention is not necessarily limited to the foregoing. One of ordinary skill in the art would appreciate that this embodiment is not limiting to the invention, and that one or more components may be modified in accordance with the teachings herein or that which is known in the art.

Examples

The following examples are provided for the purpose of illustrating the present invention, but without limiting the scope thereof.

Example Lubricant Composition 1 was prepared by mixing together the components as shown in Table 2 as follows.

TABLE 2

| Component | Composition | Amount (weight %) |
|---|---|---|
| Base-stock | Low Viscosity PAO (4 cSt ChevronPhillips PAO4) | 23.5 |
| Base-stock | Diester (Cognis Synative 2970/diisodecladipate) | 7.5 |
| Base-stock | Group III mineral base oil | 23 |
| Viscosity Improver | High Viscosity PAO (ExxonMobil or Chemtura PAO-100) | 20 |
| Viscosity Improver | Olefin Copolymer (Mitsui Lucant 1100) | 16 |
| Additive | API GL-5 Additive Package (Lubrizol Ang 6004M) | 10 |
| Pour-Point Depressant | Pour-Point Depressant (HiTEC ® 5739) | 0.3 |
| Antifoam Additive | Antifoam Additive (Dow Corning DC-200/60,000) | 0.002 |

Comparative lubricant compositions are identified below in Table.

TABLE 3

| Components | Comparative Example 802-206-3 | Comparative Example 802-206-6 | Comparative Example Delo ESI | Comparative Example Mopar | Comparative Example E-2924 |
|---|---|---|---|---|---|
| SAE | 80W90 | 75W90 | 80W90 | 75W140 | 75W90 |
| Angamol 6004 | 10 | 10 | | | |
| PAO 100 | 40.5 | 36.5 | | | |
| Solvent Nuetral115 | 49.5 | 0 | | | |
| PA06 | 0 | 53.5 | | | |

Low-Temperature Viscosity Performance of Lubricants Measured by Brookfield Viscometer: ASTM D 2983

The objective of this test is to directly measure apparent viscosity. An oleaginous fluid sample is preheated, allowed to stabilize at room temperature, and then poured to a predetermined depth into a glass cell and an insulated or uninsulated spindle inserted through a special stopper and suspended by a clip. The contained sample is cooled to a predetermined temperature for 16 hours and analyzed by a Brookfield viscometer and, depending on the viscometer used, the viscosity of the test fluid is read directly from the viscometer or the resultant torque reading is used to calculate the viscosity of the oil at the temperature chosen. The results of the Brookfield viscometer tests at −26° and −40° C. are reported below in Table 4.

Kinematic Viscosity Performance of Lubricants: ASTM 0445

The objective of this test is to measure kinematic viscosity. The time is measured for a fixed volume of liquid to flow under gravity through the capillary of a calibrated viscometer under a reproducible driving head and at a closely controlled and known temperature. The kinematic viscosity is the product of the measured flow time and the calibration constant of the viscometer. Two such determinations are performed to calculate a kinematic viscosity result that is the average of two acceptable determined values. The results of the kinematic viscosity tests at 100° C., 40° C., and −40° C. after 18 hours are reported below in Table 4. Also reported in Table 4 is the viscosity index of each test lubricant composition, which was calculated according to ASTM D 2270 from the kinematic viscosity values obtained at 40° C. and 100° C.

TABLE 4

| Test Method | Comparative Example 802-206-3 | Comparative Example 802-206-6 | Comparative Example Delo ESI | Comparative Example Mopar | Comparative Example E-2924 | Cognis Example Lubricant 1 |
|---|---|---|---|---|---|---|
| Kv 40° C. (cSt) | 115.3 | 109.52 | 137.6 | 195.37 | 155.45 | 157.57 |
| Kv 100° C. (cSt) | 16.28 | 15.98 | 14.26 | 26.08 | 18.28 | 23.26 |
| Kv −40° @ 18 hrs (cSt) | solid | 67,086 | solid | 180,508 | 145,973 | 146,169 |
| −40° C. Brook-field Viscosity (cP) | 553,000 | 60,200 | >10 million | 165,707 | 133,195 | 119,586 |
| −26° C. Brook-field Viscosity (cP) | | | 148,000 | 26,200 | 19,600 | 18,800 |
| VI | 152 | 156 | 101 | 168 | 131 | 178 |

As can be seen from Table 4 above, the lubricant composition in accordance with the present invention is a high viscosity lubricant composition meeting low temperature performance requirements. In particular, the inventive lubricant compositions achieve a kinematic viscosity of at 23.26 cSt at 100° C. (a viscosity grade of SAE 110), while also demonstrating a kinematic viscosity of 146,169 cSt at −40° C. for 18 hours.

What is claimed is:

1. A method of lubricating a gear comprising:

obtaining a lubricant composition that comprises:

(a) base-stock comprising:

(i) at least one low viscosity polyalphaolefin manufactured by catalytic oligomerization of one or more linear α-olefins ranging from 1-octene to 1-dodecene in an amount in the range of about 1-46% by weight of the lubricant composition, (ii) at least one ester in an amount in the range of about 5-30% by weight of the lubricant composition, and (iii) at least one API Group III mineral base oil in an amount in the range of about 1-23% by weight of the lubricant composition;

(b) viscosity improver comprising:

(i) at least one high viscosity polyalphaolefin manufactured by catalytic oligomerization of one or more linear α-olefins ranging from 1-octene to 1-dodecene in an amount in the range of about 10-30% by weight of the lubricant composition, and (ii) at least one olefin copolymer in an amount in the range of about 1-25% by weight of the lubricant composition;

(c) a performance additive package comprising at least one extreme pressure agent based on sulfur chemistry and at least one anti-wear agent based on phosphorous chemistry in an amount in the range of about 5-10% by weight of the lubricant composition;

(d) at least one pour-point depressant in an amount in the range of about 0.1-2% by weight of the lubricant composition; and, optionally, (e) at least one antifoam agent in an amount in the range of about 0.001-0.004% by weight of the lubricant composition;

wherein ingredients (a)(i), (a)(ii), (b)(i), (b)(ii), (c), (d), and (e) total 100%, wherein said lubricant composition has an apparent viscosity of less than about 150,000 cP at −40° C., a kinematic viscosity of less than about 150,000 cSt at −40° C., and a kinematic viscosity of at least about 18.5 cSt at 100° C.; and contacting the gear with the lubricant composition;

wherein the lubricant composition meets the American Petroleum Institute's GL-5 and SAE J2360 performance classification requirements for automotive gear, axle, and manual transmission lubricants.

2. The method of claim 1, wherein the gear is a hypoid gear.

3. The method of claim 1, wherein the lubricant composition comprises:

(a) about 12-23% by weight of the low viscosity polyalphaolefin;

(b) about 7.5-20% by weight of the ester;

(c) about 12-23% by weight of the Group III mineral base oil;

(d) about 15-25% by weight of the high viscosity polyalphaolefin;

(e) about 10-20% by weight of the olefin copolymer;

(f) about 7.5-9% by weight of the performance additive package;

(g) about 0.1-1% by weight of the pour-point depressant; and, optionally (h) about 0.001-0.004% by weight of the antifoam agent.

4. The method of claim 1, wherein the ester comprises one or more of di-isodecyl adipate, di-isodecyl azelate, di-tridecyl adipate, trimethylolpropane trioleate, 1,2-propylene glycol dioleate, and neopentylglycol dioleate.

5. The method of claim 1, wherein the performance additive package further comprises one or more of a dispersant, an antioxidant, a corrosion inhibitor, and an anti-rust agent.

6. The method of claim 1, wherein the kinematic viscosity is in the range of about 18.5 to <32.5 cSt at 100° C.

7. The method of claim 6, wherein the kinematic viscosity is in the range of about 18.5 to <24.0 cSt at 100° C.

8. The method of claim 1, wherein the at least one low viscosity polyalphaolefin has a kinematic viscosity of about 4 cSt at 100° C. and the at least one high viscosity polyalphaolefin has a kinematic viscosity in the range of >40 to about 100 cSt at 100° C.

* * * * *